US008028967B2

(12) United States Patent
Busekros et al.

(10) Patent No.: US 8,028,967 B2
(45) Date of Patent: Oct. 4, 2011

(54) DEVICE AND METHOD FOR MOUNTING A TURBINE ENGINE

(75) Inventors: Armin Busekros, Zurich (CH); Olatunde Omisore, Nussbaumen b. Rieden (CH); Thomas Wilhelm, Ennetbaden (CH)

(73) Assignee: Alstom Technology Ltd, Baden (CH)

( * ) Notice: Subject to any disclaimer, the term of this patent is extended or adjusted under 35 U.S.C. 154(b) by 374 days.

(21) Appl. No.: 12/211,454

(22) Filed: Sep. 16, 2008

(65) Prior Publication Data

US 2009/0064685 A1 Mar. 12, 2009

Related U.S. Application Data

(63) Continuation of application No. PCT/EP2007/051649, filed on Feb. 21, 2007.

(30) Foreign Application Priority Data

Mar. 17, 2006 (CH) ..... 0412/06

(51) Int. Cl.
*F16M 3/00* (2006.01)

(52) U.S. Cl. ..... 248/671; 248/676

(58) Field of Classification Search ..... 248/638, 248/637, 671, 676, 154, 650, 632; 415/1, 415/213.1; 60/797
See application file for complete search history.

(56) References Cited

U.S. PATENT DOCUMENTS

| | | | | |
|---|---|---|---|---|
| 3,628,884 A | | 12/1971 | Mierley, Sr. | |
| 4,484,447 A | | 11/1984 | Gueraud | |
| 4,850,091 A | | 7/1989 | Stadelmann | |
| 5,271,218 A | | 12/1993 | Taylor | |
| 5,346,165 A | * | 9/1994 | Frean et al. | 248/146 |
| 5,366,198 A | * | 11/1994 | Dickinson | 248/550 |
| 5,607,133 A | * | 3/1997 | Markham et al. | 248/313 |
| 5,944,297 A | * | 8/1999 | Flower et al. | 248/638 |
| 2002/0197147 A1 | | 12/2002 | Kawai et al. | |

FOREIGN PATENT DOCUMENTS

DE 10 13 466 B 8/1957

(Continued)

OTHER PUBLICATIONS

PCT/ISA/210.
PCT/ISA/237.
Office Action mailed Jun. 14, 2011 for corresponding Japanese Application No. 2008-558756.

*Primary Examiner* — Ramon Ramirez
(74) *Attorney, Agent, or Firm* — Buchanan Ingersoll & Rooney PC

(57) ABSTRACT

A device and a method for mounting a turbine engine, e.g., a gas turbine system, are described, in which a rotor unit is mounted to rotate inside a stationary external housing, having at least two supports for taking up the weight of the turbine engine, these supports being arranged at a spacing from one another in an axial longitudinal direction in relation to the external housing and at one side being articulated directly or indirectly on the external housing and at the other being supported directly or indirectly on a base frame. At least one support provides at least one support face which is supported exclusively in partial regions on at least two support plate elements. The at least one support face of the support is in operational engagement with the base frame by way of the support plate elements.

22 Claims, 2 Drawing Sheets

FOREIGN PATENT DOCUMENTS

| | | | |
|---|---|---|---|
| DE | 71 30 642 | U | 8/1973 |
| DE | 43 13 527 | A1 | 10/1994 |
| GB | 1 125 171 | A | 8/1968 |
| JP | 11-173107 | | 6/1999 |
| JP | 2000-328964 | | 11/2000 |
| JP | 2002 276306 | A | 9/2002 |

* cited by examiner

DEVICE AND METHOD FOR MOUNTING A TURBINE ENGINE

RELATED APPLICATIONS

This application claims priority under 35 U.S.C. §119 to Swiss Application No. 00412/06 filed in Switzerland on Mar. 17, 2006, and as a continuation application under 35 U.S.C. §120 to PCT/EP2007/051649 filed as an International Application on Feb. 21, 2007 designating the U.S., the entire contents of which are hereby incorporated by reference in their entireties.

TECHNICAL FIELD

A device and a method are disclosed for mounting a turbine engine, e.g., a gas turbine system, in which a rotor unit is mounted to rotate inside a stationary external housing, having at least two supports for taking up the weight of the turbine engine, these supports being arranged at a spacing from one another in an axial longitudinal direction in relation to the external housing and at one side being articulated directly or indirectly on the external housing and at the other being supported directly or indirectly on a base.

BACKGROUND INFORMATION

Powerful gas turbine systems have a rotor unit which, depending on the output capacity, typically have lengths of approximately 10 m, along which a compressor unit, the combustion chamber and at least one turbine stage are arranged. In the case of so-called sequentially operated gas turbine systems, a second combustion chamber and a further, downstream turbine blade arrangement are additionally provided along the rotor unit. Rotor units of this kind, which are predominantly made in one piece, are completely surrounded by a stationary housing which for the purpose of stable mounting of the overall gas turbine system in relation to a base is supported by way of a plurality of supports. For an illustration of the mounting concept used hitherto for gas turbine systems, the reader is referred to FIGS. 2*a* and *b*, where FIG. 2*a* is a diagrammatic cross section through a gas turbine system, and FIG. 2*b* is a perspective overview of a gas turbine system and the supports required to mount it. Conventionally, for the purpose of mounting a substantially tubular gas turbine system 1 there serve support struts 13 which rise vertically above a base 22 and at one end are firmly connected to the base 22 and at the other bear against corresponding support contoured elements 4 on the housing 5. Typically, a plurality of support struts 13 that are spaced axially in relation to the gas turbine system 1 serve to provide a reliable mounting of the gas turbine system 1 in three dimensions in relation to a base 22 which takes up the entire force of the weight of the gas turbine. It can be seen from the perspective illustration in FIG. 2*b* that in each case a plurality of support struts 13 are provided to left and right of the engine axis A in order to support the gas turbine system 1. It is clear that vibrations in operation as a result of the large masses set in rotation by the rotor unit 6 are almost unavoidable and will become clearly evident in the form of structural resonance, in particular close to the rated operational speed of rotation of the gas turbine system, and depending on their intensity will at the least impair start-up of the gas turbine system and at worst will make it impossible. An additional factor is the fact that, because of longitudinal thermal expansion, a mounting of a gas turbine system must on the one hand provide slide faces for expansion in the axial direction but on the other has to ensure stable axial seating, the more so since there is a not inconsiderable axial thrust in the axial direction of throughflow as a result of the expansions of hot gas within the turbine stages, and this thrust has to be countered.

Conventionally, the unexpected vibration, which cannot be precisely calculated, when gas turbine systems are started up will be countered by measures which are complex from the point of view of engineering construction, by providing additional structural elements which are capable of reducing the vibration behavior of the gas turbine system, in particular when the operational speed of rotation is reached, both on rotary components of the rotor unit and on the stationary gas turbine housing. Making a theoretically precise predictive calculation of disruptive structural resonance of this kind is on the one hand very complex and yet on the other cannot be performed with a satisfactory degree of precision, the more so since once a gas turbine system has been installed broad variations in the frequency at which the respective structural resonance appears will occur. Thus, it is perfectly possible for disruptive structural resonance to occur below or above the respective operational speeds of rotation, in some cases even with gas turbine systems of the same construction. Not least for economic reasons, it is essential to keep the vibration which occurs in operation with gas turbine systems within acceptable limits, the more so since excessive vibration will put the operational reliability of the entire gas turbine system in doubt and ultimately result in a costly decommissioning of the entire gas turbine system.

SUMMARY

Exemplary embodiments disclosed herein can construct a device for mounting a turbine engine, e.g., a gas turbine system, in which a rotor unit is mounted to rotate inside a stationary external housing, having at least two supports for taking up the weight of the turbine engine, these supports being arranged at a spacing from one another in an axial longitudinal direction in relation to the external housing and at one side being articulated directly or indirectly on the external housing and at the other being supported directly or indirectly on a base frame mounted on a base, such that a decisive influence is exerted on the structural resonance behavior set up and caused by vibration in a gas turbine system in operation, in which the gas turbine system is to be mounted to minimize vibrate. The measures required for this are to be constructionally simple and as far as possible capable of being performed on site after assembly of the gas turbine system, rapidly and without great complexity from the point of view of engineering construction.

A device for mounting a turbine engine is disclosed, e.g., a gas turbine system, in which a rotor unit is mounted to rotate inside a stationary external housing, having at least two supports for taking up the weight of the turbine engine, these supports being arranged at a spacing from one another in an axial longitudinal direction in relation to the external housing and at one side being articulated directly or indirectly on the external housing and at the other being supported directly or indirectly on a base frame, wherein at least one support provides at least one support face which is supported exclusively in partial regions on at least two support plate elements, and wherein the at least one support face of the support is in operational engagement with the base frame by way of the support plate elements.

A method for mounting a turbine engine is disclosed, e.g., a gas turbine system, such that vibration is reduced, in which a rotor unit is mounted to rotate inside a stationary external housing, having at least two supports for taking up the weight of the turbine engine, these supports being arranged at a spacing from one another in an axial longitudinal direction in relation to the external housing and at one side being articulated directly or indirectly on the external housing and at the other side being supported directly or indirectly on a base frame, wherein there is provided on at least one support a horizontally oriented support face, which is arranged vertically opposite a bearing face that is provided on the base frame, and wherein between the support face and the bearing face there are inserted at least two laterally spaced from each other support plate elements such that the force of the weight of the turbine engine bears on the base frame entirely by way of the support plate elements, such that in operation of the turbine engine vibration is minimized.

Further details can be seen from the description below.

BRIEF DESCRIPTION OF THE DRAWINGS

The disclosure will be described below by way of example, without restricting the overall inventive idea, by way of exemplary embodiments, given with reference to the drawing, in which.

DETAILED DESCRIPTION

Figure 1:
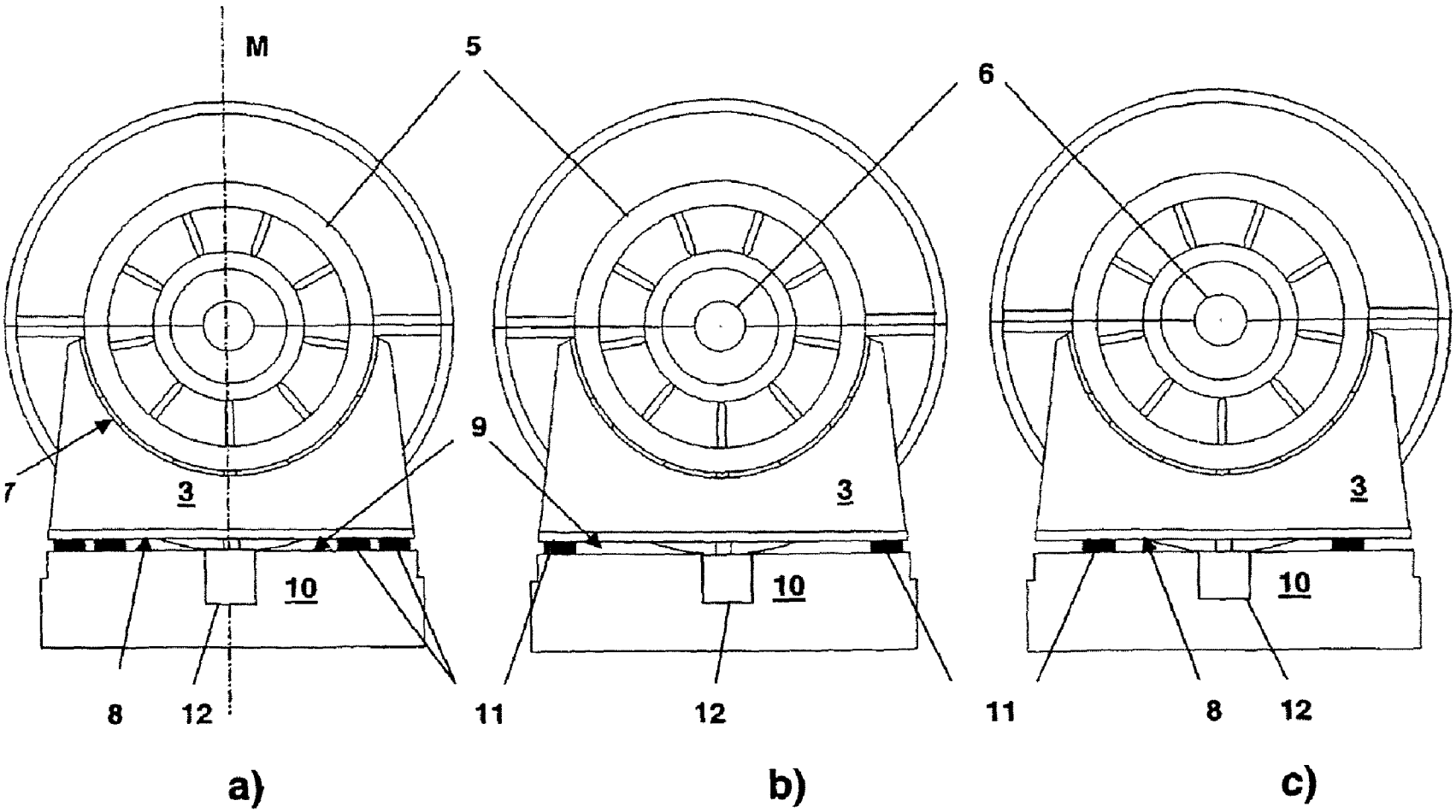
FIGS. 1*a, b, c* show diagrammatic illustrations of cross sections through an exemplary gas turbine system with a) a rigid seating, b) a mounting of medium rigidity, and c) a mounting of low rigidity, and FIGS. 2*a, b* show a cross section through a known gas turbine system, and a perspective view.

According to the disclosure, a device for mounting a turbine engine, e.g., a gas turbine system, has at least one support which provides at least one support face which is supported exclusively in partial regions on at least two support plate elements. At least one support face of the support is in operational engagement with the base frame by way of the support plate elements.

The disclosure makes it possible to make later adjustments to the mounting of a gas turbine system which is fully assembled on site, with the result that the vibration that is characteristic of an individual gas turbine system can be influenced in an effective manner, merely by a controlled arrangement of the so-called support plate elements, by way of which ultimately in certain parts the force of the weight of the entire gas turbine system acts on a supporting base frame. As the statements below, in particular those referring to the exemplary embodiment below, will show, the inherent elasticity which is characteristic of the support in particular in the region of the support face, which because of the support plate elements is spaced from the base frame in a cantilever arrangement, is utilized to influence in controlled manner the resonant vibration of the gas turbine system in operation. Depending on the positioning, number and size of the support plate elements that are to be provided between the support face of the support and the bearing face on the base frame side, the rigidity or elasticity of the coupling between the support and the base frame may be varied almost continuously, and hence the position of the resonant frequencies of the structure and the rotor unit of the gas turbine system may be varied in a controlled manner. By appropriate placement of suitably dimensioned support plate elements, any structural resonance which may occur when the gas turbine system is in operation may thus be shifted effectively into another frequency range—regardless of whether it occurs below or above certain operational speeds of rotation.

The exchange or the positioning, adapted to the respective structural resonance, of the respective support plate elements in relation to the support face of the support can be performed on site in a short time using simple technical means, with the result that delays to starting up the gas turbine system caused by vibration can be avoided or at least reduced to a minimum. For this, all that is required is a suitably constructed lifting device which is designed to take the load of the gas turbine system and enables the gas turbine system to be raised briefly in the region of the support, with the result that the support plate elements, which are otherwise loose between the base and the support, can be suitably shifted in relation to the support face of the support.

If it is essential for mounting of the gas turbine system to be made as rigid as possible in relation to the base frame, for example, it is useful to provide more than two support plate elements between the support and the base frame, with the result that the proportion of support face which is spaced freely in relation to the base frame is as small as possible. If, by contrast, the support is to be as elastic as possible, it is useful to have two support plate elements, which should be provided in suitable manner between the support and the base frame. Further details can be seen from the description below, with reference to the exemplary embodiment. Numerical calculations indicate that with the aid of the support concept according to the disclosure the rigidity and hence the elastic behavior of the support can be varied by approximately +/−30%, making it possible to shift the structural resonance of the gas turbine system either above or below the operational speed of rotation.

The mounting according to the disclosure is achieved by a method according to the disclosure for mounting a turbine engine, e.g., a gas turbine system, such that vibration is reduced, in which a rotor unit is mounted to rotate inside a stationary external housing, having at least two supports for taking up the weight of the turbine engine, these supports being arranged at a spacing from one another in an axial longitudinal direction in relation to the external housing and at one side being articulated directly or indirectly on the external housing and at the other being supported directly or indirectly on a base frame, which is characterized in that there is provided on at least one support a horizontally oriented support face, which is arranged vertically opposite a bearing face that is provided on the base frame. Between the support face and the bearing face there are inserted at least two laterally spaced from each other support plate elements such that the force of the weight of the turbine engine bears on the base frame entirely by way of the support plate elements such that in operation the turbine engine is mounted to minimize vibrate.

If further system components are added to the turbine engine later on, the method can be applied again in suitable manner to adjust the mounting to the new vibration behavior.

For this purpose, the number and arrangement of support plate elements inserted between the support face and the bearing face are such that the support face of the support provides free surface regions which are spaced from the bearing face and are mounted to vibrate in a suitably dimensioned manner. To increase the rigidity of the free surface regions of the support face that are mounted to vibrate, more than two support plate elements are provided; if it is essential to construct the mounting as elastically as possible, only two support plate elements which are made as small as possible are provided. It is also possible, instead of providing two, three or more support plate elements of small surface area, to provide large support plate elements of suitable surface area in order to ensure a desired relatively rigid or relatively soft mounting of the gas turbine system.

In principle, the device concept according to the disclosure serves to provide a reduced vibration or vibration-free mounting of a turbine engine, e.g., a gas turbine system, but it goes without saying that the concept may also be used in similar way to mount with little vibration any system components that are connected to the turbine engine and that at least substantially determine the vibration behavior of the turbine engine. These include in particular add-on parts, which may be assembled on the turbine engine or disassembled therefrom in an extremely short time and which bring about a decisive change in the rigidity of the engine.

Figure 2:
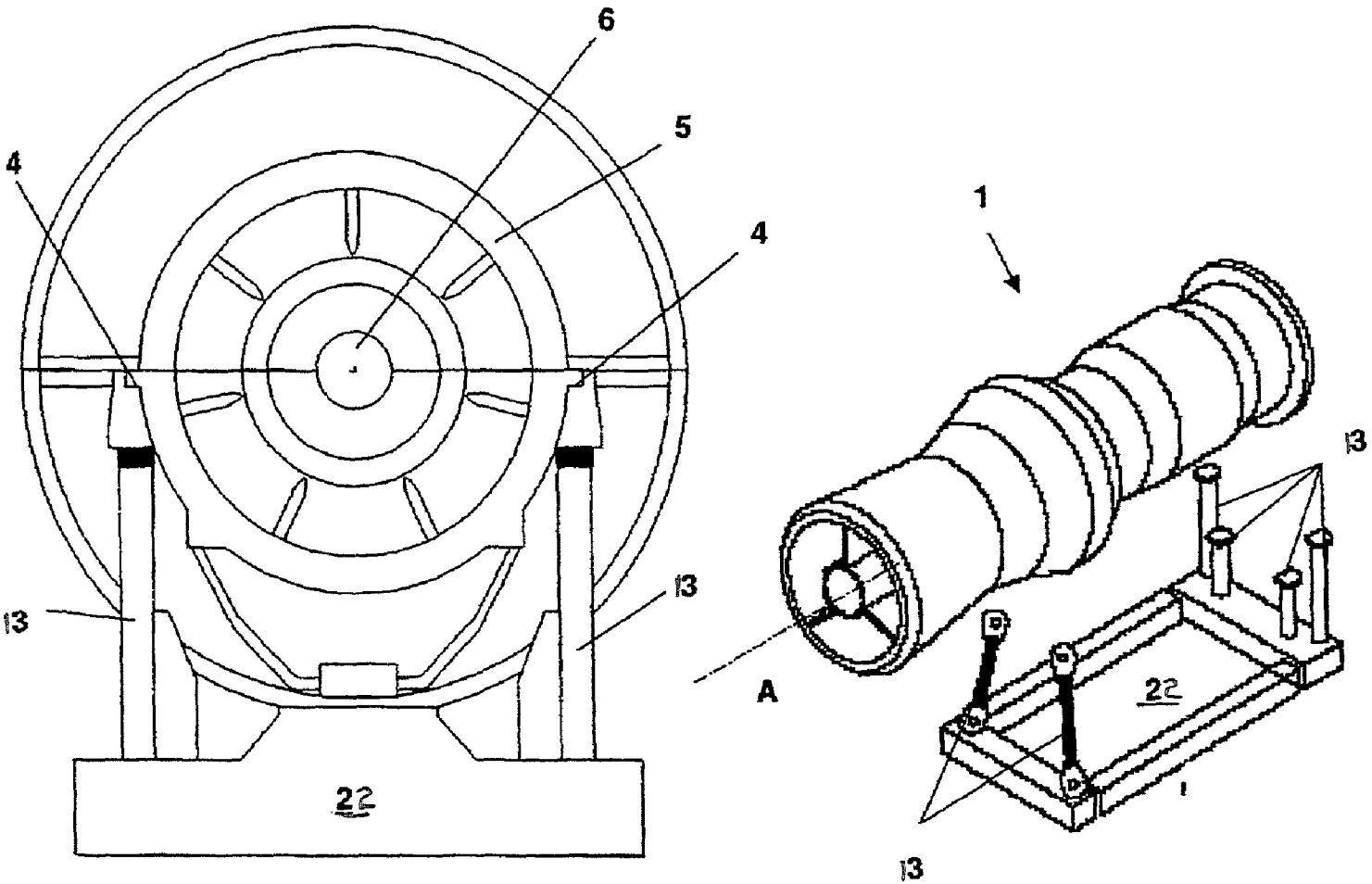

FIGS. 1*a* to *c* show illustrations which in all cases are diagrammatic, of cross sections through a gas turbine system similar to the pictorial illustration in FIG. 2*a*. Unlike the support which is illustrated with reference to FIG. 2*a* and which is known per se, the support concept according to the disclosure provides a support 3 which is to be provided axially at one side in an end region of the gas turbine system or, alternatively, in both axially opposed end regions of the gas turbine system.

The support 3 according to the disclosure has a receiver 7 that is adapted to be a complementary contour to the external contour of the external housing 5 of the gas turbine system 1, and that firmly connects the support 3 to the external housing 5. The connection may be made conventionally by way of detachable screw connections to ensure ease of assembly. The receiver 7, which in the exemplary embodiment is in the shape of a semicircle, reaches largely around the whole of the lower half of the external housing 5, with the result that the support 3 securely supports the gas turbine system in both the horizontal and the vertical directions. The support 3 furthermore has a planar, horizontally oriented support face 8 which is arranged opposite a similarly planar and horizontally oriented bearing face 9 of a load-bearing base frame 10. Provided between the support face 8 and the bearing face 9 are so-called support plate elements 11 which space the support 3 from the base frame 10 by a gap corresponding to the respective thickness of the support plate elements 11. The support plate elements 11 serve as spacer elements and can have only a small surface area themselves, with the result that they overlap with the support face 8 to as small as possible an extent, in order in this way to retain a high degree of adjustability of the inherent elasticity of the support face 8. However, the essential point is to adjust the rigidity or elasticity of the supports 3 in relation to the vibration of the gas turbine system 1 that is respectively in operation using simple technical means in order to influence the structural resonance.

With the support concept according to the disclosure, the elasticity and the associated capacity for vibration of the surface regions of the support face 8 that are spaced freely from the base frame 10 are utilized. The support face 8 is constructed as a planar surface, mounted horizontally and symmetrically in relation to the center axis M, which at the same time represents a line of the center of gravity through the gas turbine engine. This means that it is always intersected by the line of the center of gravity, ensuring a secure mounting of the gas turbine system. The vibration behavior of the support face 8 of the support 3 may be influenced by the number and arrangement of support plate elements 11 that are inserted between the support 3 and the base frame 10. If, for example in accordance with the exemplary embodiment in FIG. 1*a*, four support plate elements 11 are provided which are each arranged symmetrically in relation to the center axis M and are located in the lateral marginal regions of the opposing support face 8 and bearing face 9, then a high degree of rigidity is obtained along the support face 8 of the support 3. If, however, only two support plate elements 11 are inserted, in accordance with the arrangement in FIG. 1*b*, then the support face 8 is able to deform elastically more easily than in the case of FIG. 1*a*. The lowest level of surface rigidity is obtained with an arrangement of the support plate elements 11 in accordance with the arrangement in FIG. 1*c*.

As a function of the respective resonant vibration behavior of the gas turbine system in operation, support plate elements 11 of different constructions may be placed between the support face 8 and the bearing face 9. Advantageously, lifting means 12 may be integrated within the base base frame 10, and these means are able briefly to take up the load of the gas turbine system in the region of the support 3 and to raise the support face 8 in relation to the base frame 10. Since the support plate elements 11 lie loosely on the bearing face 9 of the base frame 10, they may readily be accessed so that they can be shifted by hand. Similarly, it is possible to adjust the respective support height of each individual support plate element individually, by laying further spacer plates on the respective support plate elements. Once the individual support plate elements 11 have been arranged and adjusted appropriately, the lifting means 12, which can be integrated in the base frame 10, are lowered so that the portions of the force of the weight of the gas turbine system that create a load on the support 3 are introduced into the base frame 10 by way of the support plate elements 11.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE NUMERALS

1 Gas turbine system
2 Base
3 Support
4 Contoured element of the support
5 External housing
6 Rotor unit
7 Receiver
8 Support face
9 Bearing face
10 Base frame
11 Support plate element
12 Lifting means

What is claimed is:

1. A device for mounting a turbine engine or a gas turbine system, in which a rotor unit is mounted to rotate inside a stationary external housing, comprising:

at least two supports for taking up the weight of the turbine engine, these supports being arranged at a spacing from one another in an axial longitudinal direction in relation to the external housing and at one side being articulated on the external housing and at an other being supported on a base frame, wherein at least one support provides at least one support face which is supported in regions on at least two support plate elements, and wherein the at least one support face of the support is in operational engagement with the base frame by way of the support plate elements.

2. The device as claimed in claim 1, wherein the support face is planar and horizontally oriented.

3. The device as claimed in claim 2, wherein the at least two support plate elements are inserted directly between the support face of the support and a bearing face of the base frame.

4. The device as claimed in claim 1, wherein the at least two support plate elements are inserted directly between the support face of the support and a bearing face of the base frame.

5. The device as claimed in claim 4, wherein the base frame is mechanically relieved of the force of the weight of the turbine engine and the support plate elements lie loosely on the bearing face of the base frame and may be shifted laterally in relation to the bearing face.

6. The device as claimed in claim 5, wherein there is provided a lifting device which raises the turbine engine, together with the support, relative to the bearing face of the base frame.

7. The device as claimed in claim 6, wherein the support plate elements are made in one piece or include a plurality of individual spacer disks which are arranged in a stack.

8. The device as claimed in claim 4, wherein the support plate elements are clamped between the support face and the base frame exclusively by the force of the weight of the turbine engine.

9. The device as claimed in claim 1, wherein the support plate elements are clamped between the support face and the base frame exclusively by the force of the weight of the turbine engine.

10. The device as claimed in claim 9, wherein the base frame is mechanically relieved of the force of the weight of the turbine engine and the support plate elements lie loosely on the bearing face of the base frame and may be shifted laterally in relation to the bearing face.

11. The device as claimed in claim 1, wherein the support plate elements are made in one piece or include a plurality of individual spacer disks which are arranged in a stack.

12. The device as claimed in claim 11, wherein the at least one support supports the turbine engine symmetrically in relation to the axis of rotation passing through the rotor unit, and wherein the support face intersects perpendicularly a line of the center of gravity of the turbine engine.

13. The device as claimed in claim 1, wherein the at least one support supports the turbine engine symmetrically in relation to the axis of rotation passing through the rotor unit, and wherein the support face intersects perpendicularly a line of the center of gravity of the turbine engine.

14. The device as claimed in claim 13, wherein the support face is configured and arranged to be symmetrical in relation to the one line of the center of gravity.

15. The device as claimed in claim 14, wherein the at least one support provides a receiver that has a complementary contour to the external housing of the turbine engine and extends around almost half of the external housing, and by way of which the support is firmly connected to the external housing.

16. The device as claimed in claim 1, wherein the at least one support provides a receiver that has a complementary contour to the external housing of the turbine engine and extends around almost half of the external housing, and by way of which the support is firmly connected to the external housing.

17. The device as claimed in claim 16, wherein the at least two support plate elements provide a reduced vibration or vibration-free mounting for a turbine engine and/or system components that are connected to the turbine engine and contribute to determining the vibration behavior of the turbine engine.

18. The device as claimed in claim 1, wherein the at least two support plate elements provide a reduced vibration or vibration-free mounting for a turbine engine and/or system components that are connected to the turbine engine and contribute to determining the vibration behavior of the turbine engine.

19. The device as claimed in claim 18, wherein the position, number and plate thickness of the support plate elements are selected as a function of the vibration behavior of the turbine engine in operation, and the support plate elements are arranged in relation to the support face of the support such that the turbine engine is mounted to vibrate as little as possible.

20. A method for mounting a turbine engine or a gas turbine system, such that vibration is reduced, in which a rotor unit is mounted to rotate inside a stationary external housing, the method comprising:

arranging at least two supports for taking up the weight of the turbine engine at a spacing from one another in an axial longitudinal direction in relation to the external housing and at one side being articulated on the external housing and at an other side being supported on a base frame;

providing on at least one support a horizontally oriented support face, which is arranged vertically opposite a bearing face that is provided on the base frame; and inserting between the support face and the bearing face at least two laterally spaced from each other support plate elements such that the force of the weight of the turbine engine bears on the base frame by way of the support plate elements, such that in operation of the turbine engine vibration is minimized.

21. The method as claimed in claim 20, wherein the number and arrangement of support plate elements inserted between the support face and the bearing face is such that the support face of the support provides free surface regions which are spaced from the bearing face.

22. The method as claimed in claim 21, providing more than two support plate to increase the rigidity of the free surface regions and the support face.

* * * * *